US005699855A

United States Patent [19]

Mitsuhashi

[11] Patent Number: 5,699,855

[45] Date of Patent: Dec. 23, 1997

[54] PLATE FIN HEAT EXCHANGER AND METHOD OF MAKING THEREOF

[75] Inventor: Kenichiro Mitsuhashi, Takasago, Japan

[73] Assignee: Kabushiki Kaisha Kobe Seiko Sho, Kobe, Japan

[21] Appl. No.: 623,848

[22] Filed: Mar. 29, 1996

[30] Foreign Application Priority Data

Mar. 31, 1995 [JP] Japan ..... HEI 7-099800

[51] Int. Cl.[6] ..... C23C 8/16

[52] U.S. Cl. ..... 165/133; 165/DIG. 513; 148/285

[58] Field of Search ..... 165/133, 134; 148/285; 29/890.03

[56] References Cited

U.S. PATENT DOCUMENTS

| | | | |
|---|---|---|---|
| 3,380,860 | 4/1968 | Lipinski | 148/266 |
| 3,728,164 | 4/1973 | Abe et al. | 148/274 |
| 5,385,203 | 1/1995 | Mitsuhashi et al. | 165/110 |

FOREIGN PATENT DOCUMENTS

| | | | |
|---|---|---|---|
| 510950 | 10/1992 | European Pat. Off. | 148/285 |
| 272110 | 12/1978 | Germany | 148/285 |
| 2-254140 | 10/1990 | Japan | 148/285 |
| 3-122260 | 5/1991 | Japan | 148/285 |

*Primary Examiner*—Allen J. Flanigan

*Attorney, Agent, or Firm*—Oblon, Spivak, McClelland, Maier & Neustadt, P.C.

[57] ABSTRACT

To prevent with certainty corrosion by mercury even in nonoperating of plant facilities, plate fins 1 and flat plates 2 of flow passage members constituting cooled fluid passages and refrigerant passages are formed by an aluminum alloy and on surfaces of the plate fins 1 and the flat plates 2, an oxide film formed by a reaction between the aluminum alloy and an oxidizing component in an oxidizing gas is formed, or a hydroxide film formed by a reaction between the aluminum alloy and an alkaline component in an alkaline aqueous solution is formed.

8 Claims, 2 Drawing Sheets

PLATE FIN HEAT EXCHANGER AND METHOD OF MAKING THEREOF

BACKGROUND OF THE INVENTION 1. (Field of the Invention)

The present invention relates to a plate fin heat exchanger made of an aluminum alloy for exchanging heat of a raw material including mercury and a method of making thereof.

2. (Description of the Related Art)

A plate fin heat exchanger is constituted by a simple structure which is formed by an aluminum alloy having an excellent mechanical strength at low temperatures and in which cooled fluid passages and refrigerant passages are arranged alternately. Therefore, the heat exchanger is much used in plant facilities such as a liquefied natural gas plant etc. requiring heat exchange especially at low temperatures.

Meanwhile, mercury is often included in raw material of plant facilities and mercury is apt to remain in a plate fin heat exchanger by exchanging heat of the raw material. At this occasion the aluminum alloy forms mercury amalgam by reacting with mercury. Further, the mercury amalgam forms aluminum hydroxide and regenerates metallic mercury by causing a hydrolysis reaction induced by presence of moisture. Accordingly, when mercury and moisture are present in raw material, in the plate fin heat exchanger, flow passage members constituting cooled fluid passages or refrigerant passages in contact with the raw material are continuously corroded by which the life of the heat exchanger is shortened.

Conventionally, corrosion of a plate fin heat exchanger is prevented by carrying out (1) a measure of completely preventing invasion of moisture into plant facilities, (2) a measure of holding the facilities at low temperatures to fix moisture or (3) a measure of constructing a structure capable of completely excluding remaining mercury, to eliminate at least one of mercury and moisture which are substances causing corrosion.

However, according to the measures of eliminating substances causing corrosion such as mercury or moisture etc. as in the above-mentioned conventional cases, when the facilities are completely stopped in nonoperating of the plant facilities, the elimination of the substances causing corrosion is apt to be insufficient and accordingly, there is danger of corroding the plate fin heat exchanger.

SUMMERY OF THE INVENTION

It is an object of the present invention to provide a plate fin heat exchanger capable of preventing with certainty corrosion even in nonoperating of plant facilities.

It is another object of the present invention to provide an effective method for making the above-mentioned plate fin heat exchanger.

An explanation will be given of preferable embodiments of plate fin heat exchangers according to the present invention. In the plate fin heat exchanger flow passage members constituting cooled fluid passages and refrigerant passages of a plate fin heat exchanger main body are formed by an aluminum alloy and an oxide film formed by a reaction between the aluminum alloy of the flow passage members and an oxidizing component of an oxidizing gas, is formed on the surface of the above-mentioned flow passage members. Further, the film formed on the surface of the above-mentioned flow passage members may be formed by a hydroxide film which is formed by a reaction between the aluminum alloy of the flow passage members and an alkaline component in an alkaline aqueous solution.

According to the above-mentioned constitution an oxide film or a hydroxide film is positively formed on the surface of the flow passage members constituting the cooled fluid passages and the refrigerant passages and direct contact of mercury included in a raw material that becomes a cooled fluid or a refrigerant with an aluminum alloy of the flow passage members is prevented by these films and accordingly, corrosion can be prevented with certainty even in nonoperating of the plant facilities.

An explanation will be given of a preferable method of making a plate fin heat exchanger according to the present invention. According to this method an atmospheric gas having an oxygen concentration of 25 through 35% is enclosed in the above-mentioned cooled fluid passages and refrigerant passages and the plate fin heat exchanger main body is left in a heating atmosphere at 250° through 350° C. for several hours by which an aluminum alloy of the flow passage members and the oxidizing component in the oxidizing gas are made react with each other whereby an oxide film is formed on the surface of the flow passage members. In case where a hydroxide film is formed on the surface of the flow passage members, an aqueous solution of sodium hydroxide having the concentration of 1 through 7% at a normal temperature is introduced in the above-mentioned cooled fluid passages and refrigerant passages and the solution is held for several tens seconds by which the hydroxide film can be formed.

According to this method, in comparison with a case where flow passage members on surfaces of which a film has previously been formed are integrated, defects of the film caused by welding etc. in assembling operation can be prevented and a uniform film can be formed on the surface of the flow passage members.

DETAILED DESCRIPTION OF REFEREED EMBODIMENTS

An explanation will be given of an embodiment according to the present invention in reference to FIG. 1 and FIG. 2.

Figure 1:
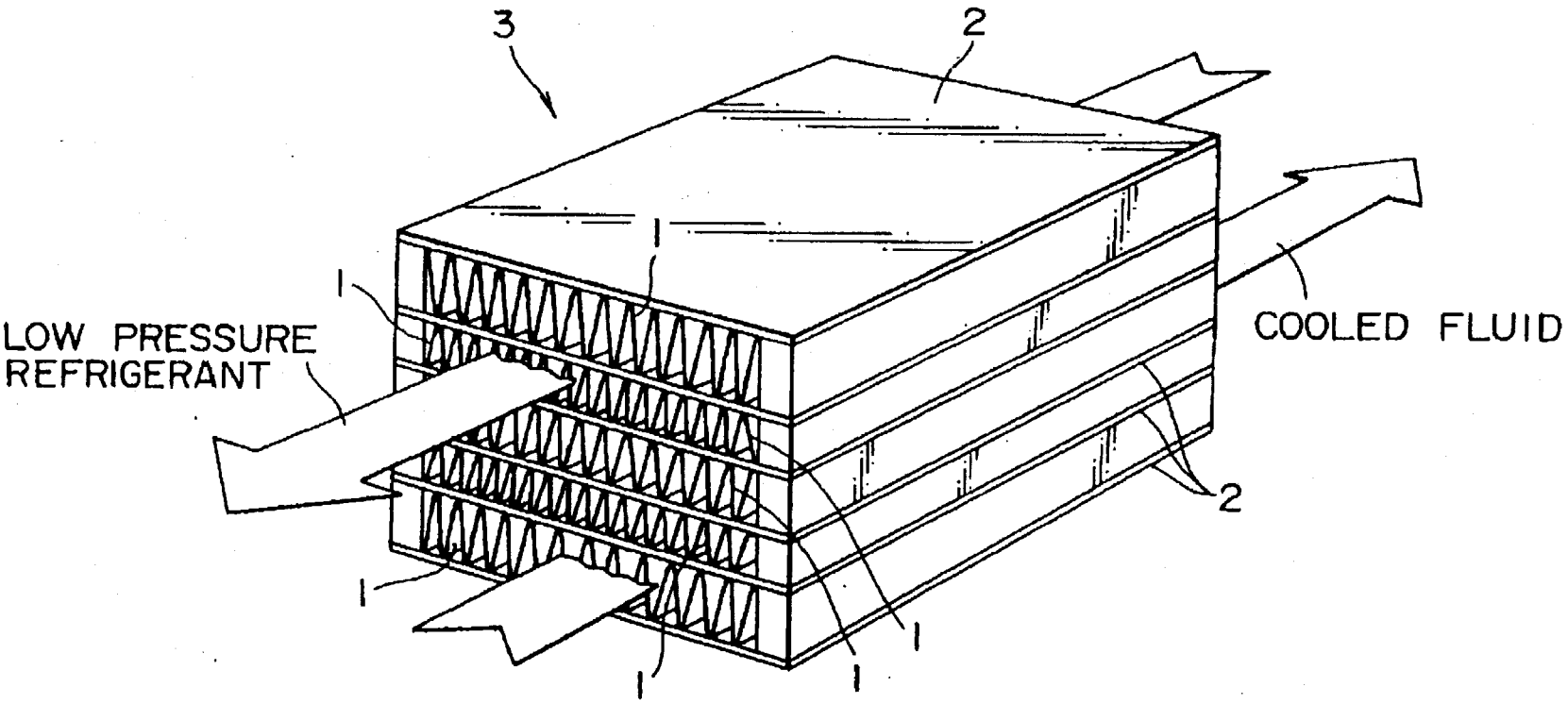
FIG. 1 is a perspective view of a plate fin heat exchanger.

As shown in FIG. 1, a plate fin heat exchanger of the present invention is provided with a plate fin heat exchanger main body 3 (hereinafter, heat exchanger main body 3) having a structure in which pluralities of plate fins 1 which are wavily formed and flat plates are alternately laminated and cooled fluid passages and refrigerant passages are alternately arranged among the contiguous flat plates 2 such that a cooled fluid and a refrigerant are brought into contact via the flat plates 2.

An aluminum alloy such as 3003 series material or 5083 series material etc. is used in flow passage members (plate fin 1, flat plate 2) constituting the above-mentioned cooled fluid passages and refrigerant passages and an oxide film or a hydroxide film is formed on the surface of the flow passage members to prevent corrosion by mercury. These films are provided with a film thickness of 20 through 170 μm such that they are not easily eroded by the flowing cooled fluid or refrigerant and direct contact of mercury that is present in the cooled fluid or the refrigerant with the aluminum alloy that is the material of the flow passage members, is prevented.

Further, there exists a naturally formed oxide film on an unprocessed surface of the aluminum alloy. However, in this case the film thickness of the oxide film is not sufficient and accordingly, it is easily eroded by the flowing cooled fluid or refrigerant, mercury invades into defect portions of the films by stress variation or vibration in operation and mercury corrosion is progressed. By contrast, according to the above-mentioned constitution the oxide film or the hydroxide film is positively formed and the film is provided with a sufficient film thickness whereby the film is not easily eroded and therefore, deficiency of the film caused by erosion by raw material or stress variation and vibration in operation can be prevented. As a result corrosion by mercury can be avoided by preventing contact of mercury with the aluminum alloy over the entire period of time in operating and nonoperating of the plant facilities.

In case of an oxide film, the above-mentioned film is formed by introducing an oxidizing gas into internal portions (cooled fluid passages and refrigerant passages) of the heat exchanger main body 3, hermetically sealing inlets and outlets of all the passages, mounting the heat exchanger main body 3 in a heating furnace and leaving the heat exchanger main body 3 in a heating atmosphere for several hours by which the aluminum alloy and the oxidizing component in the oxidizing gas are made react with each other.

Further, an atmospheric gas having an oxygen concentration of 25 through 35%, ozone ($O_3$), chlorine gas ($Cl_2$), $NO_x$ etc. can be used for the oxidizing gas. Further, when an atmospheric gas having the oxygen concentration of 25 through 35% is used as the oxidizing gas, it is preferable that the temperature of the heating atmosphere is in a range of 250° through 350° C. and time for leaving the heat exchanger main body (processing time) is approximately 5 hours.

The reason for rendering the oxygen concentration in the range of 25 through 35% when an atmospheric gas is used as the oxidizing gas and the reason for rendering the heating atmosphere in forming the oxide film in the range of 250° through 350° C. are as follows. When either one of the oxygen concentration and the heating atmosphere is below a lower limit value (25%, 250° C.), the oxygen concentration or the heating temperature is so low that a time period for forming the oxide film is prolonged, it becomes difficult to increase the film thickness and as a result it becomes difficult to form a film to a degree by which mercury particles do not reach material face of aluminum. On the other hand, when either one of the oxygen concentration and the heating atmosphere exceeds an upper limit value (35%, 350° C.), while the oxide film is easy to grow, the oxygen concentration or the heating temperature is so high that crystal grains are magnified and accordingly, a film defect to a degree by which mercury particles reach material face of aluminum is formed.

Meanwhile, when the film is a hydroxide film, an alkaline aqueous solution at a normal temperature is introduced into internal portions (cooled fluid passages and refrigerant passages) of the heat exchanger main body 3, the alkaline aqueous solution is held for several tens seconds and the aluminum alloy and the alkaline component in the alkaline aqueous solution are made react with each other by which the hydroxide film is formed.

Further, a solution of sodium hydroxide (NaOH), potasium hydroxide (KOH), calcium hydroxide ($Ca(OH)_2$), magnesium hydroxide ($Mg(OH)_2$) etc. can be used as the alkaline aqueous solution. Further, when a solution of sodium hydroxide is used for the alkaline aqueous solution, it is preferable that the concentration of sodium hydroxide is in a range of 1 through 7% and time for leaving (processing time) is approximately 90 seconds.

The reason of rendering the concentration to 1 through 7% when an aqueous solution of sodium hydroxide is used as the alkaline aqueous solution is as follows. When the concentration is below 1%, the alkaline concentration is so low that a time period of forming a hydroxide film is prolonged, it becomes difficult to increase the film thickness and as a result, it becomes difficult to form a film to a degree by which mercury particles do not reach material face of aluminum. On the contrary, when it exceeds 7%, the alkaline concentration is so high that crystal grains are magnified and accordingly, a film defect to a degree by which mercury particles reach material face of aluminum is formed.

In the above-mentioned constitution, it has been confirmed by carrying out the following test that corrosion resistance is improved by the film formed on the heat exchanger main body 3.

Firstly, two kinds of aluminum alloy plates having the plate thickness of 3 mm and made of 3003 series material and 5083 series material were prepared. Further, test pieces of 3003 series material and test pieces of 5083 series material were provided by cutting these aluminum alloy plates into a dimension of 10 mm×150 mm. Further, as shown in Table 1, as film forming conditions the test pieces were left in a heating atmosphere having the oxygen concentration of 20% at 200° C. and with respect to the test pieces of the respective materials, ones formed with oxide films after leaving them for 1 hour and ones formed with oxide films by leaving them for 10 hours, were provided. Thereafter, the heating atmosphere as one of the film forming conditions is changed to 300° C. and 400° C. and test pieces having the respective materials and formed with oxide films were provided by the procedure similar to the above-mentioned.

TABLE 1

| Film forming conditions | | | Weight increase by corrosion (mg) ASME SB209M | | Oxide film thickness (Å) ASME SB209M | |
|---|---|---|---|---|---|---|
| Oxygen | Temper-ature | Time | | | | |
| Vol % | °C. | Hr | 3003 | 5083 | 3003 | 5083 |
| 20 | 200 | 1 | 3.8 | 9.1 | 21.6 | 36.3 |
| 20 | 200 | 10 | 2.7 | 7.6 | 25.3 | 56.6 |
| 20 | 300 | 1 | 4.5 | 7.5 | 32.6 | 73.6 |
| 20 | 300 | 10 | 2.9 | 5.1 | 45.6 | 162.3 |
| 20 | 400 | 1 | 7.1 | 11.9 | 57.0 | 222.0 |
| 20 | 400 | 10 | 3.1 | 8.8 | 137.0 | 556.6 |
| | | | 10.1 | 15.2 | — | — |

Figure 2:
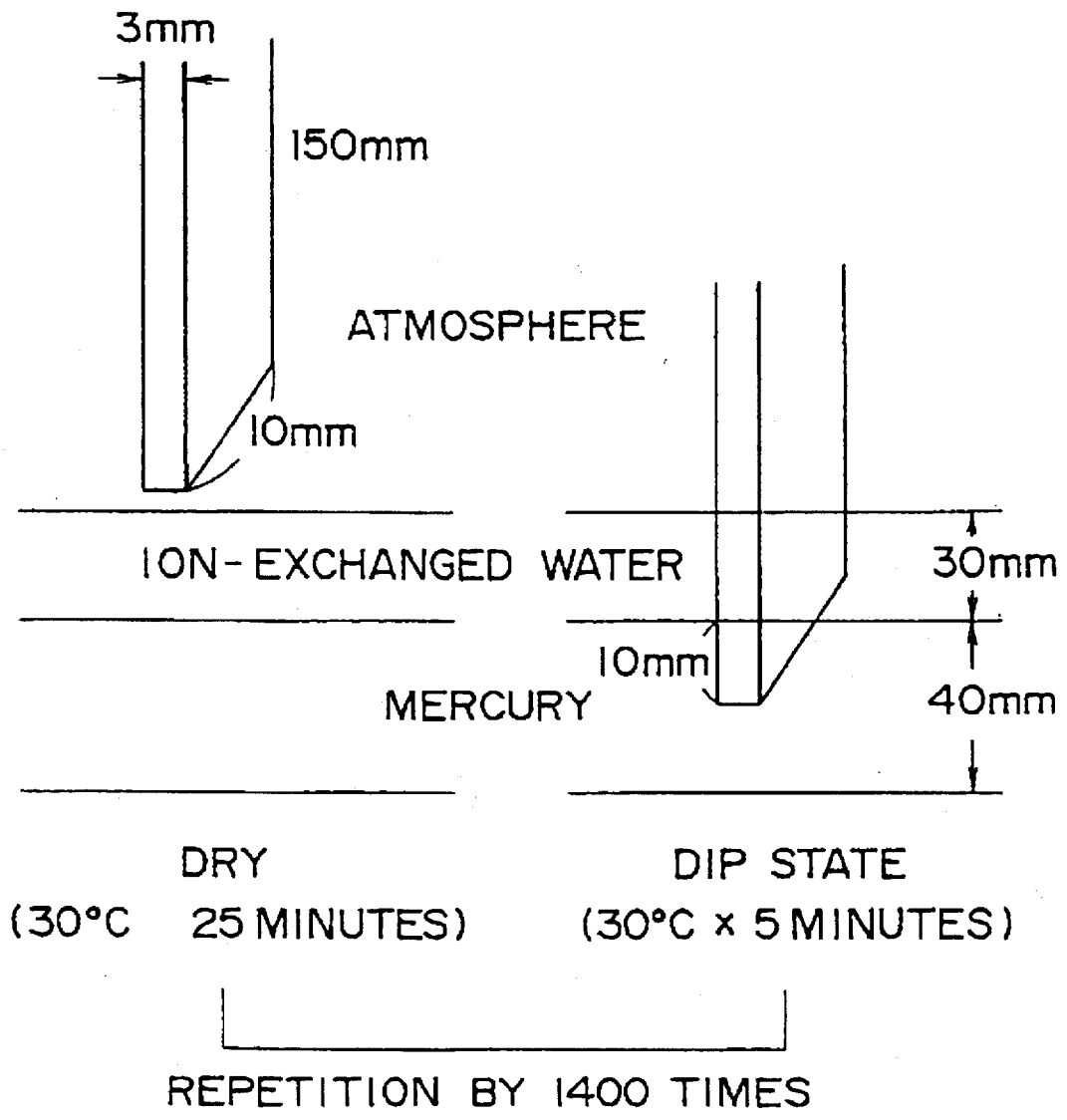
FIG. 2 is an explanatory view of a dip corrosion test.

Next, after measuring the weight of each test piece, the test piece was mounted in a dip corrosion tester (made by Suga Tester DW-UD-3) and as shown in FIG. 2, the test piece was vertically moved in an up and down movement with respect to a water tank storing mercury having a thickness of 40 mm and ion-exchanged water having a thickness of 30 mm by which a state (dry state) where the test piece was present in the atmosphere and a state (dip state) where the test piece was in contact with ion-exchanged water and mercury, were repeated. Further, the dry state lasted 25 minutes at 30° C. and the dip state lasted 5 minutes at 30° C.

Thereafter, after repeating the drying and dipping for 1400 times, the weight of each test piece was measured and an weight increase by corrosion was calculated. Further, as test pieces for comparison, two kinds of aluminum alloy plates made of 3003 series material and 5083 series material were prepared, the respective test pieces in a state (unprocessed) in which an oxide film was not formed, were mounted in the dip corrosion tester, the drying and dipping was repeated by 1400 times and under the same conditions the weight increase was calculated. As a result, as shown in Table 1, under the film forming conditions of the oxygen concentration of 20%, the heat treatment temperature of 200° through 400° C. and the processing time of 1 through 10 hours, the weight increase by corrosion of the processed test pieces was more alleviated than that of the unprocessed test pieces and it was confirmed that the effect was significant especially at the processing temperature of 300° C.

Next, as shown in Table 2, the oxide film was formed with respect to test pieces of two kinds of aluminum alloy plates made of 3003 series material and 5083 series material by changing the oxygen concentration while maintaining constant the heating temperature (300° C.) and the processing time (5 hours). Further, a SSRT (Slow Strain Rate Test) test was carried out by using these respective test pieces and unprocessed test pieces for comparison and elongation (mm) up to rupture was measured.

TABLE 2

| Film forming conditions | | | Elongation up to rupture by SSRT test (mm) | | Oxide film thickness (Å) | |
|---|---|---|---|---|---|---|
| Oxygen | Temper -ature | Time | | | | |
| Vol % | °C. | Hr | 3003 | 5083 | 3003 | 5083 |
| 5 | 300 | 5 | 8.1 | 2.2 | 35 | 63 |
| 20 | 300 | 5 | 9.1 | 7.2 | 39 | 68 |
| 25 | 300 | 5 | 9.2 | 7.5 | 41 | 70 |
| 35 | 300 | 5 | 9.5 | 7.3 | 42 | 70 |
| 40 | 300 | 5 | 9.5 | 3.7 | 42 | 42 |
| | | | — | 1.4 | — | — |

As a result, as shown in Table 2, with respect to the rupture characteristic the 5083 series material shows excellent values at the oxygen concentration of 25 through 35% and the 3003 series material shows excellent values in which the higher the concentration the better the value, under the film forming conditions of the oxygen concentration of 5 through 40%, the heat treatment temperature of 300° C. and the processing time of 5 hours. Therefore, it has been confirmed that the mercury corrosion resistance of the heat exchanger can be promoted for both materials of 5083 series material and 3003 series material by maintaining the oxygen concentration at the interior of the heat exchanger at 25 through 35% and by heating the heat exchanger at around 300° C. for 5 hours.

Next, as shown in Table 3, with respect to test pieces of an aluminum alloy plate made of 5083 series material, a hydroxide film was formed by dipping the test pieces in aqueous solutions having the concentration of sodium hydroxide of 1% and 7% at a normal temperature for 90 seconds. Further, the elongation (mm) up to rupture was measured by carrying out the SSRT test by using each of the test pieces and unprocessed test pieces for comparison.

TABLE 3

| Film forming conditions | | Elongation up to rupture by |
|---|---|---|
| NaOH (%) | Dip time (sec) | SSRT test (mm) 5083 |
| 1 | 90 | 2.8 |
| 7 | 90 | 7.3 |
| | | 1.4 |

As a result, as shown in Table 3, it has been confirmed that the test pieces formed with hydroxide films under the above-mentioned film forming conditions, were provided with improved rupture characteristic under a mercury corrosion environment in comparison with that of the unprocessed test pieces and the mercury corrosion resistance of the heat exchanger can be promoted by carrying out the processing at the interior of the heat exchanger.

What is claimed is:

1. A plate fin heat exchanger, comprising:

cooled fluid passages, and refrigerant passages, wherein said cooled fluid passages and said refrigerant passages comprise an aluminum alloy and an oxide film on surfaces of said cooled fluid passages and said refrigerant passages, and said oxide film is prepared by a process comprising reacting said aluminum alloy and an oxidizing gas comprising 25–35 volume % oxygen.

2. The plate fin heat exchanger according to claim 1, wherein a film thickness of the oxide film is set to be 20 through 170 μm.

3. A method of making a plate fin heat exchanger, comprising:

forming an oxide film on surfaces of cooled fluid passages and refrigerant passages of a plate fin heat exchanger comprising an aluminum alloy, by reacting said aluminum alloy with an oxidizing gas comprising 25–35 volume % oxygen, at a temperature of 250°–350° C.

4. A plate fin heat exchanger, comprising:

cooled fluid passages; and refrigerant passages, wherein said cooled fluid passages and said refrigerant passages comprise an aluminum alloy and a hydroxide film on surfaces of said cooled fluid passages and said refrigerant passages, and said hydroxide film is prepared by a process comprising reacting said aluminum alloy and an alkaline aqueous solution comprising 1–7% sodium hydroxide.

5. The plate fin heat exchanger according to claim 4, wherein a film thickness of the hydroxide film is set to be 20 through 170 μm.

6. A method of making a plate fin heat exchanger, comprising:

forming a hydroxide film on surfaces of cooled fluid passages and refrigerant passages of a plate fin heat exchanger comprising an aluminum alloy, by reacting said aluminum alloy with an aqueous solution comprising 1–7% sodium hydroxide.

7. The method of claim 3, wherein a film thickness of the oxide film is set to be 20 through 170 μm.

8. The method of claim 6, wherein a film thickness of the hydroxide film is set to be 20 through 170 μm.

* * * * *